US010206501B1

(12) United States Patent
Kindred, Jr.

(10) Patent No.: US 10,206,501 B1
(45) Date of Patent: Feb. 19, 2019

(54) FOLDING STORAGE UNIT

(71) Applicant: Storage Trailers, LLC, Houston, TX (US)

(72) Inventor: Myron E. Kindred, Jr., Houston, TX (US)

(73) Assignee: Storage Trailers LLC, Houston, TX (US)

( * ) Notice: Subject to any disclaimer, the term of this patent is extended or adjusted under 35 U.S.C. 154(b) by 0 days.

(21) Appl. No.: 15/681,170

(22) Filed: Aug. 18, 2017

(51) Int. Cl.
*B65D 90/02* (2006.01)
*A47B 43/04* (2006.01)

(52) U.S. Cl.
CPC ..... *A47B 43/04* (2013.01)

(58) Field of Classification Search
CPC .. B65D 90/022; B65D 88/524; B65D 88/121; A47B 43/04
USPC ..... 294/81.5, 81.51, 81.52, 81.53, 81.1
See application file for complete search history.

(56) References Cited

U.S. PATENT DOCUMENTS 7,870,970 B2 * 1/2011 Fisk ..... B65D 88/022 220/4.28
9,045,280 B2 * 6/2015 Bellehumeur ..... B65D 88/524

* cited by examiner

*Primary Examiner* — King M Chu
(74) *Attorney, Agent, or Firm* — Patrick K. Steele

(57) ABSTRACT

A collapsible storage unit includes a base, a roof, first and second side walls, and first and second end panels. Each side wall includes an upper side wall section hinged to a side edge of the roof and a lower side wall section hinged to a side edge of the base, wherein the upper side wall section is also hinged to the lower side wall section so that each side wall can be articulated between an extended condition and an inwardly collapsed condition. Each end panel is hinged to an end of the base and can be articulated between a collapsed condition against the base and an extended condition securable to an end of the side walls. At least one of the end panels includes a door. Multiple collapsible storage units may be transported on a single flatbed surface in a collapsed condition and upright orientation.

13 Claims, 10 Drawing Sheets

FOLDING STORAGE UNIT

BACKGROUND

The present disclosure relates to a freestanding storage unit.

BACKGROUND OF THE RELATED ART

Retail stores and other businesses frequently have insufficient warehouse space for a variety of reasons. These businesses may rely upon just-in-time delivery of merchandise. However, as a practical matter, businesses frequently need more storage space than is available in their permanent buildings.

Many businesses have a need for mobile storage solutions. Often, the mobile storage is satisfied by parking a semi-trailer behind the building and keeping it full of inventory items. As additional inventory is needed, employees must enter the semi-trailer, locate desired items, and take those items into the building. This same practice may be implemented with a large shipping container. Unlike a semi-trailer, the shipping container sits lower to the ground and may be considered to be more accessible.

However, semi-trailers and shipping containers are inherently designed to satisfy transportation laws and regulations. Their continued use as a mobile storage solution is attributed mostly to their wide availability and low rental cost, not premium inventory and access solutions.

BRIEF SUMMARY

One embodiment provides a collapsible storage unit comprising a base, a roof, first and second side walls, and first and second end panels. The base is generally planar and has opposing first and second side edges and opposing first and second ends. The roof is generally planar and has opposing first and second side edges and opposing first and second ends. The first side wall includes a first upper side wall section hinged to the first side edge of the roof and a first lower side wall section hinged to the first side edge of the base, wherein the first upper side wall section is hinged to the first lower side wall section, and wherein the first upper side wall section and the first lower side wall section can be articulated between an extended condition and an inwardly collapsed condition. Similarly, the second side wall includes a second upper side wall section hinged to the second side edge of the roof and a second lower side wall section hinged to the second side edge of the base, wherein the second upper side wall section is hinged to the second lower side wall, and wherein the second upper side wall section and the second lower side wall section can be articulated between an extended condition and an inwardly collapsed condition. The first end panel includes a first frame and a first door secured to the first frame, wherein the first end panel is hinged to the first end of the base and can be articulated between an collapsed condition against the base and an extended condition securable to a first end of the first side wall and a first end of the second side wall. The second end panel including a second frame, wherein the second end panel is hinged to the second end of the base and can be articulated between a collapsed condition against the base and an extended condition securable to a second end of the first side wall and a second end of the second side wall.

Another embodiment provides a method comprising transporting a plurality of collapsible storage units on a flatbed surface in a collapsed condition and in an upright orientation with a first side edge of each storage unit resting on the flatbed surface; offloading the storage unit from the flatbed surface using a crane, wherein a hook on a second side edge of each storage unit is disposed for handling by the crane; laying the storage unit in a horizontal orientation with a base of the collapsible storage unit resting on a support surface; lifting a roof of the storage unit to expanding the storage unit from the collapsed condition to an expanded condition, wherein the storage unit has first and second side walls that each articulate from an inwardly folded condition to an extended condition; moving, with the first and second side walls in the extended condition, first and second end panels into an operative position at each end of the storage unit, wherein each end panel is hingedly secured to the base of the storage unit, and wherein the operative position of the end panels prevents the storage unit from collapsing; securing the first end panel in the operative position between first ends of the first and second side walls and securing the second end panel in the operative position between second ends of the first and second side walls; and disconnecting the crane from the roof of the storage unit after the end panels are secured to the side walls.

DETAILED DESCRIPTION

Figure 1:
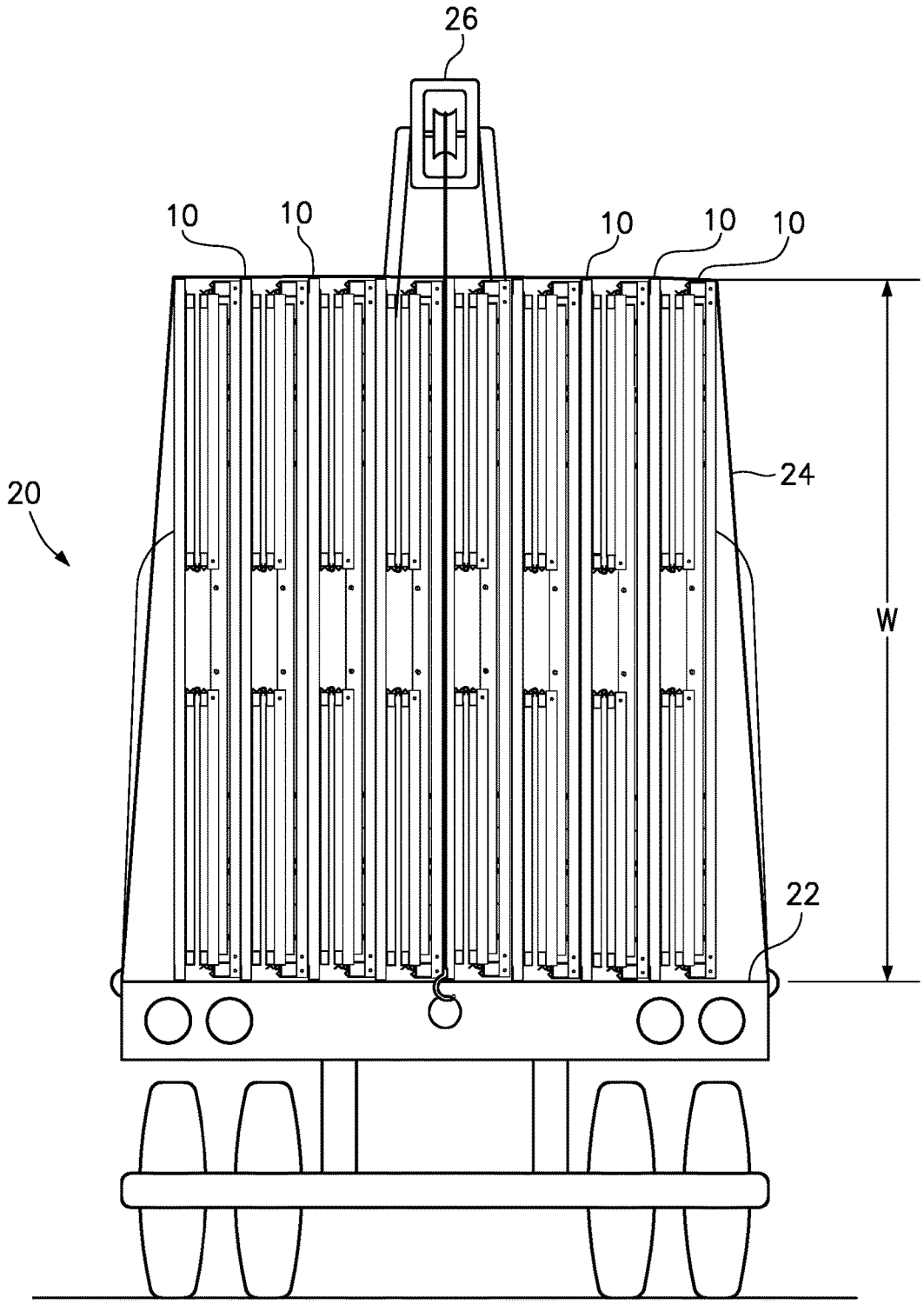
FIG. 1 is an end view of five folding storage units loaded on a flatbed boom truck.

One embodiment provides a collapsible storage unit comprising a base, a roof, first and second side walls, and first and second end panels. The base is generally planar and has opposing first and second side edges and opposing first and second ends. The roof is generally planar and has opposing first and second side edges and opposing first and second ends. The first side wall includes a first upper side wall section hinged to the first side edge of the roof and a first lower side wall section hinged to the first side edge of the base, wherein the first upper side wall section is hinged to the first lower side wall section, and wherein the first upper side wall section and the first lower side wall section can be articulated between an extended condition and an inwardly collapsed condition. Similarly, the second side wall includes a second upper side wall section hinged to the second side edge of the roof and a second lower side wall section hinged to the second side edge of the base, wherein the second upper side wall section is hinged to the second lower side wall, and wherein the second upper side wall section and the second lower side wall section can be articulated between an extended condition and an inwardly collapsed condition. The first end panel includes a first frame and a first door secured to the first frame, wherein the first end panel is hinged to the first end of the base and can be articulated between an collapsed condition against the base and an extended condition securable to a first end of the first side wall and a first end of the second side wall. The second end panel including a second frame, wherein the second end panel is hinged to the second end of the base and can be articulated between an collapsed condition against the base and an extended condition securable to a second end of the first side wall and a second end of the second side wall.

The base and roof are rigid members, which may be made with a tubular metal frame and angle iron supports within the frame. Sheet metal or other impervious sheathing or cladding may be secured to the metal frame and supports to form a water tight barrier on the roof. In one option, a 20 gauge sheet metal is used. Each of the upper and lower wall sections may be similarly constructed, although the size or gauge of the materials may vary. Plywood may be secured to the metal frame and supports (floor joints) of the base to form a floor.

The base and roof may beneficially have a width greater than 9 feet and length greater than 9 feet. In a preferred embodiment, the base and roof are about 10½ feet wide and about 21½ feet long, which may then provide an interior storage space that is about 10 feet wide and about 21 feet long. Accordingly, it is possible to store a row of standard pallets (typical dimensions of 48 inches by 48 inches) of inventory on either side of a central aisle. It is possible to leave a central aisle opening that is about 2 feet wide, such that an individual can gain easy access to each pallet. Optionally, pallets of items may be stacked two or more pallets high, such that the storage unit may accommodate about 20 fully loaded pallets.

In a collapsed condition of the storage unit, the first and second end panels are folded inward (toward each other) and laid against the base. The first and second sets of side wall sections are also folded inward (toward each other) and over the folded end panels, allowing the base and roof to collapse to a height of less than 2 feet. The storage unit may be secured in the collapsed condition with a latch, strap, bolt or other fastener to prevent unfolding during transport or offloading.

In various embodiments, first adjacent edges of the base and roof will form a flat edge with the folding storage unit in the collapsed condition, wherein the flat surface allows the folding storage unit to be set on a flat surface in an upright orientation. The flat edge formed by the first adjacent edges of the base and roof is preferably substantially perpendicular to the base and roof so that folding storage unit in the collapsed condition can sit in an upright orientation balanced on the flat edge. The folding storage unit may further include at least one hook along second adjacent edges of the base and roof. The at least one hook facilitates lifting the folding storage unit in the upright orientation with the flat edge formed by the first adjacent edges directed downward. The folding storage unit can be set side-by-side with four more of the folding storage units on a flatbed surface that is no more than 8 feet, 6 inches wide. For example, the flatbed surface may be a flatbed of a semi trailer or a flatbed of a truck. Optionally, the flatbed surface may be part of a truck or trailer equipped with a boom crane for loading and offloading the storage units as well as erecting the storage units from a collapsed condition to an operative, fully assembled condition.

In a further embodiment, each upper wall section has a lower edge that is concave and each lower wall section has an upper edge that is convex. When the upper and lower wall sections are pivoted to the extended condition, the convex edge of the lower wall section is positioned within the concave edge of the upper wall section. In this position, the interface between the convex and concave edges is weather resistant. Optionally, the concave edges and the convex edges may each be made with an angle iron creating a maintenance free moving weatherstrip.

The end panels may be secured in an upright and operative position between the first and second side walls using a metal plate and bolts or pins. The rigidity of the end panels helps support the storage unit in the fully assembled condition by preventing the wall sections from folding and the storage unit from collapsing. For example, a boom crane may lift the roof until the side walls are in the extended condition. Then a separate winch may be used to pivot the end panels into the operative position while the crane is still supporting the roof with the walls fully extended. The end panels are then secured in the operative position, such as by bolting metal plates to both the side walls and the end panel. Optionally, the end panels may be further secured in the operative position by fastening to the roof, such as with a metal plate and bolts. Other manners of fastening the end panels in place may also be used. An optional weather stripping may be secured to lateral edges of the end panels for sealing against the side walls.

One or more of the end panels should have one or more doors. For example, the first end panel may have a single door or double doors, while the second end panel may be a wall panel with no door. Optionally each end panel may have at least one door, but each end panel may have a pair of doors that swing open to provide full access to the storage unit from both ends. Regardless of whether an end panel has a single door or double doors, the door or doors will preferably open to provide full access across the full width of the storage unit.

Another embodiment provides a method comprising transporting a plurality of collapsible storage units on a flatbed surface in a collapsed condition and in an upright orientation with a first side edge of each storage unit resting on the flatbed surface; offloading the storage unit from the flatbed surface using a crane, wherein a hook on a second side edge of each storage unit is disposed for handling by the crane; laying the storage unit in a horizontal orientation with a base of the collapsible storage unit resting on a support surface; lifting a roof of the storage unit to expanding the storage unit from the collapsed condition to an expanded condition, wherein the storage unit has first and second side walls that each articulate from an inwardly folded condition to an extended condition; moving, with the first and second side walls in the extended condition, first and second end panels into an operative position at each end of the storage unit, wherein each end panel is hingedly secured to the base of the storage unit, and wherein the operative position of the end panels prevents the storage unit from collapsing; securing the first end panel in the operative position between first ends of the first and second side walls and securing the second end panel in the operative position between second ends of the first and second side walls; and disconnecting the crane from the roof of the storage unit after the end panels are secured to the side walls.

FIG. 1 is an end view of five folding storage units 10 loaded on a flatbed of a boom truck 20. The folding storage units 10 are in a collapsed condition and set on the flatbed surface 22 in an upright orientation. The upright orientation (shown) is roughly degrees from a generally horizontal orientation (see FIG. 3) in which the storage units is erected and used. Accordingly, the width (W) of the storage unit is not limited to the maximum width (currently about 8½ feet) allowed by highway transportation regulations without a special move permit.

With each storage unit having a thickness of about 18 inches in the collapsed condition, the five storage units 10 only use about 7½ feet of the width of an 8½ foot wide flatbed 22. The storage units 10 may be secured with a cargo straps 24 for transporting from one location to another. A boom crane 26 is preferably available for loading, offloading, and erecting each storage unit.

Figure 2:
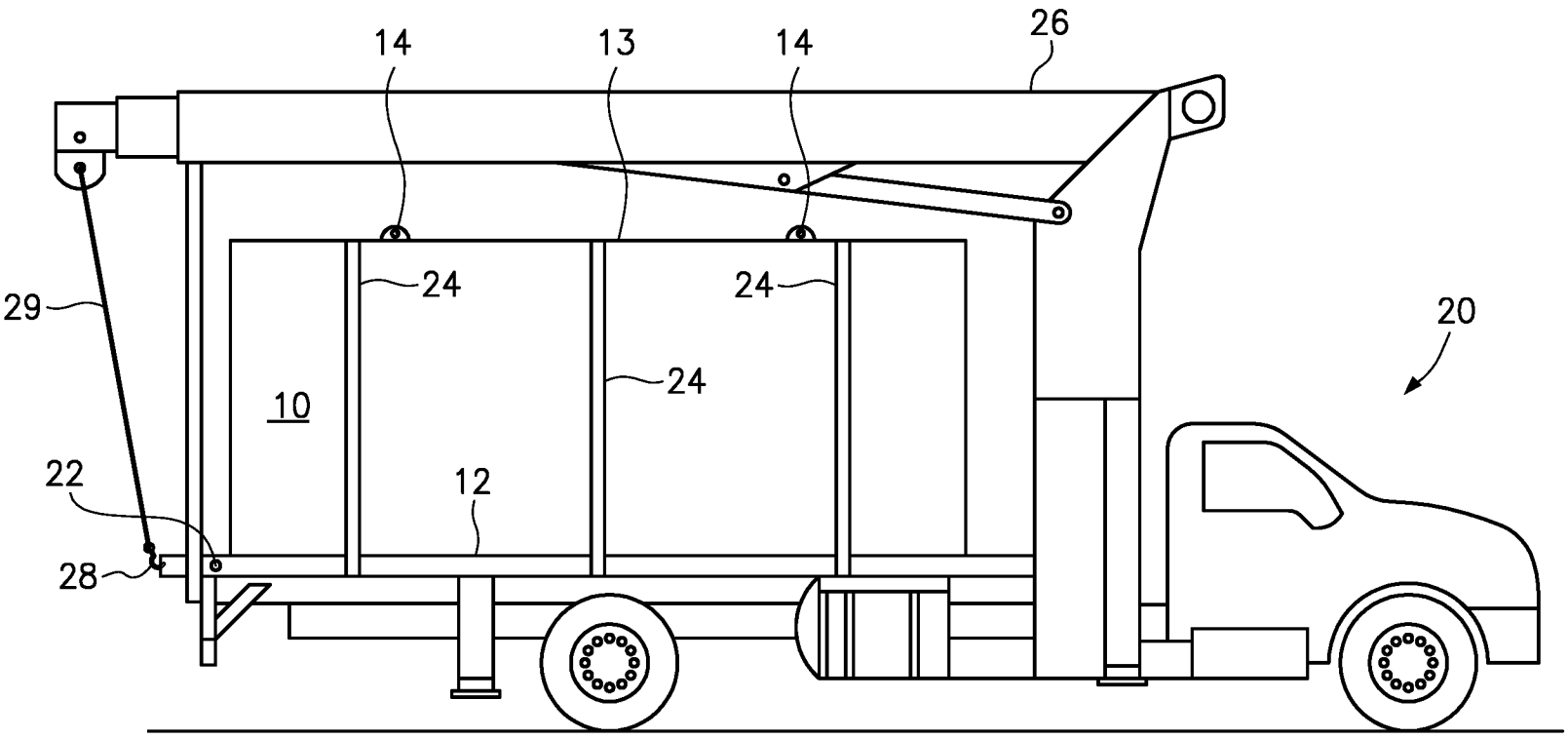
FIG. 2 is a side view of the folding storage units on the flatbed boom truck

FIG. 2 is a side view of the folding storage units 10 on the flatbed 22 of the boom truck 20. The folding storage units 10 are secured with three cargo straps 24, with a flat edge 12 set on the flatbed surface 22 and an opposing edge 13 including a pair of eye hooks 14. After arriving at a destination where at least one of the storage units 10 is to be erected, the cargo straps 24 are removed and the boom crane 26 is operated to offload a storage unit 10. Specifically, the boom crane 26 is raised and a pair of hooks or other fasteners 28 on the end of the wire rope 29 are secured to the eye hooks 14 on the storage unit 10. The boom crane 26 may then lift the storage unit 10 and set it on an adjacent surface where the storage unit is to be erected.

Figure 3:
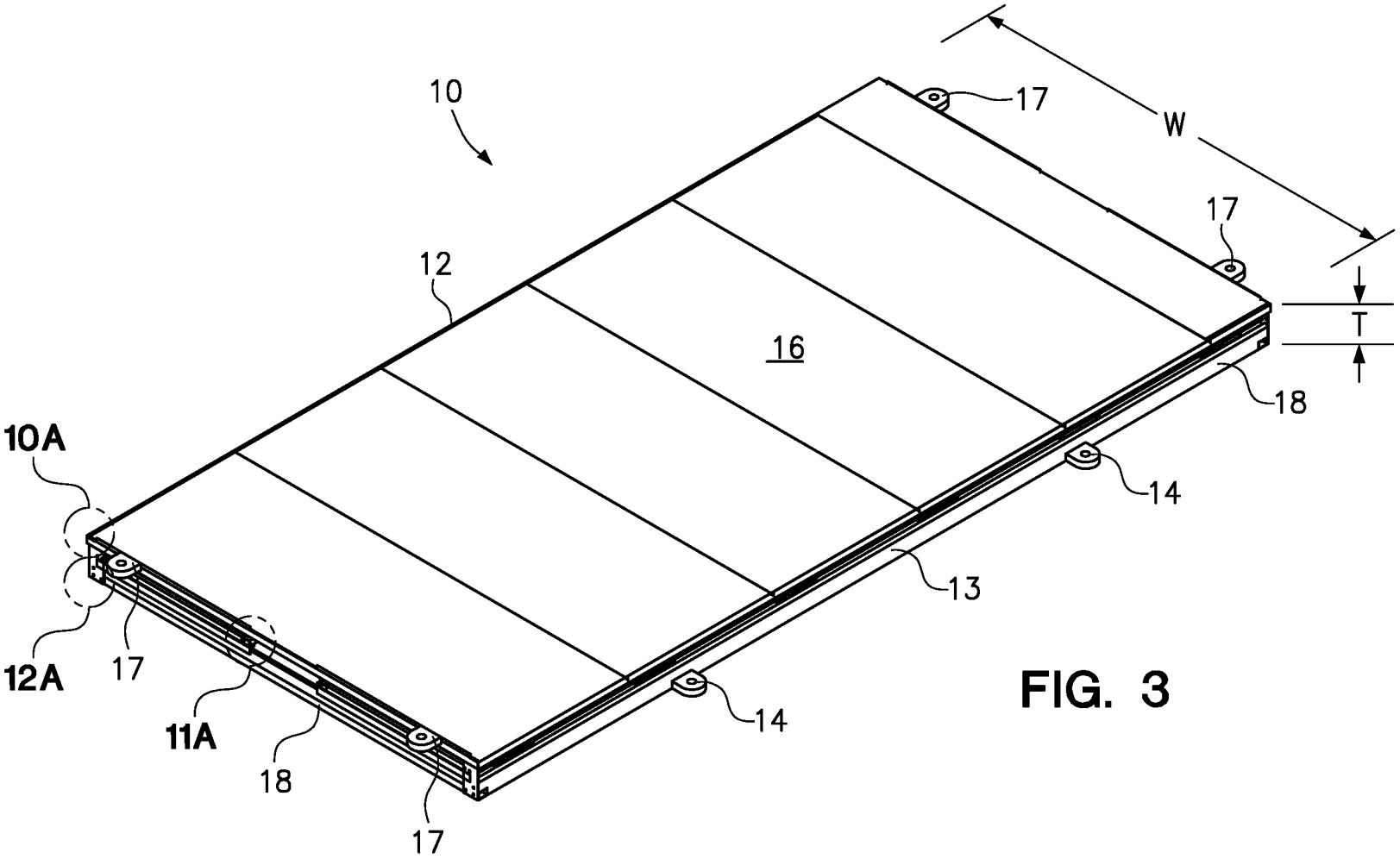
FIG. 3 is a perspective view of a folding storage unit set on a flat surface in a collapsed condition.

FIG. 3 is a perspective view of a folding storage unit 10 laying in a horizontal orientation on a flat surface in a collapsed condition. The opposing edges 12, 13 can still be seen to each side. A roof 16 is upwardly directed and a base 18 is downwardly directed for contact with the ground, pavement or other available surface. The next step in erecting the storage unit 10 is to disconnect the boom crane hooks 28 from the eye hooks 14 (used for loading and offloading the storage unit 10) and connect the boom crane hooks 28, or perhaps other or additional fasteners, to eye hooks 17 that are attached to the roof 16. The number and arrangement of the eye hooks 17 may be varied, but the eye hooks 17 are shown extending to the ends of the storage unit 10, such that the eye hooks 17 do not add to the overall thickness (T) of the storage unit 10 and do not interfere with the flat edge 12 upon which the storage unit 10 is set during transportation. The boom crane then lifts the roof upward to expand the storage unit.

Figure 4:
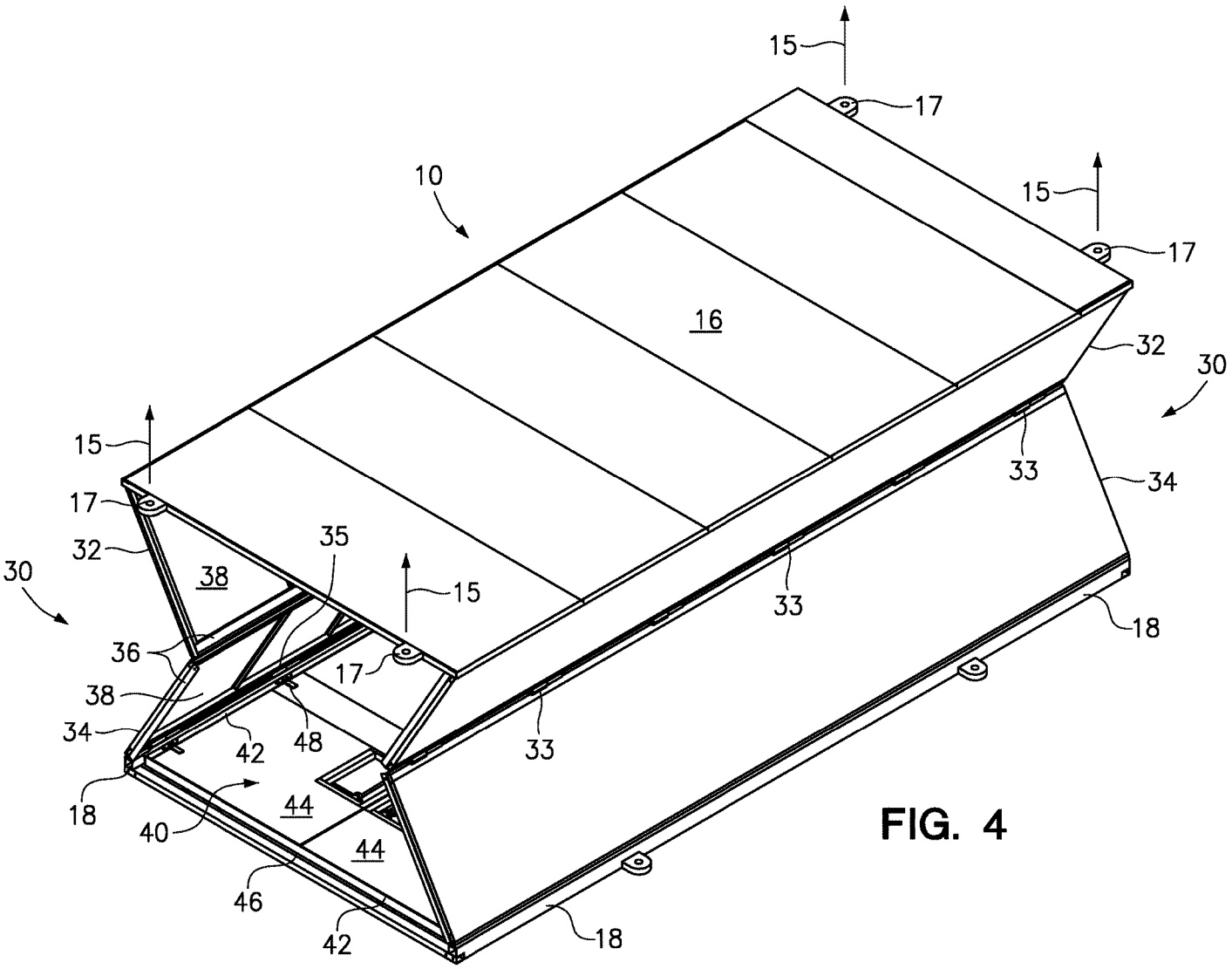
FIG. 4 is a perspective view of the folding storage unit during folding or unfolding of the walls.

FIG. 4 is a perspective view of the folding storage unit 10 during unfolding (extending) of the walls 30. The roof 16 has been lifted in the direction of the arrows 15 by the boom crane attached to the eye hooks 17. Each wall 30 includes an upper wall section 32 and a lower wall section 34, and each wall section 32, 34 may be made with a tubular metal or angle iron frame 36 and sheet metal 38 secured to the frame. Each upper wall section 32 has an upper edge coupled by a hinge (not shown; see hinge 31 in FIGS. 10A-10B) to a side edge of the roof 16, and each lower wall section 34 has a lower edge coupled by a hinge 35 to the base 18. Still further, the upper wall section 32 is coupled by a hinge 33 to the lower wall section 34. It should be recognized that a few spaced apart hinges 33 or a single long hinge may be used. The operation of the hinges 31, 33, 35 are described in more detail with reference to FIGS. 10A-10B, 11A-11B and 12A-12B.

With the storage unit 10 partially expanded, it is easier to see the end panel 40, which includes a rigid, rectangular frame 42 (only two sides are shown) and a pair of doors 44 secured within the rigid frame 42. The rigid frame 42 is coupled with a hinge 46 to the end of the base 18, and the doors 44 are coupled with hinges 48 to the rigid frame 42.

Figure 5:
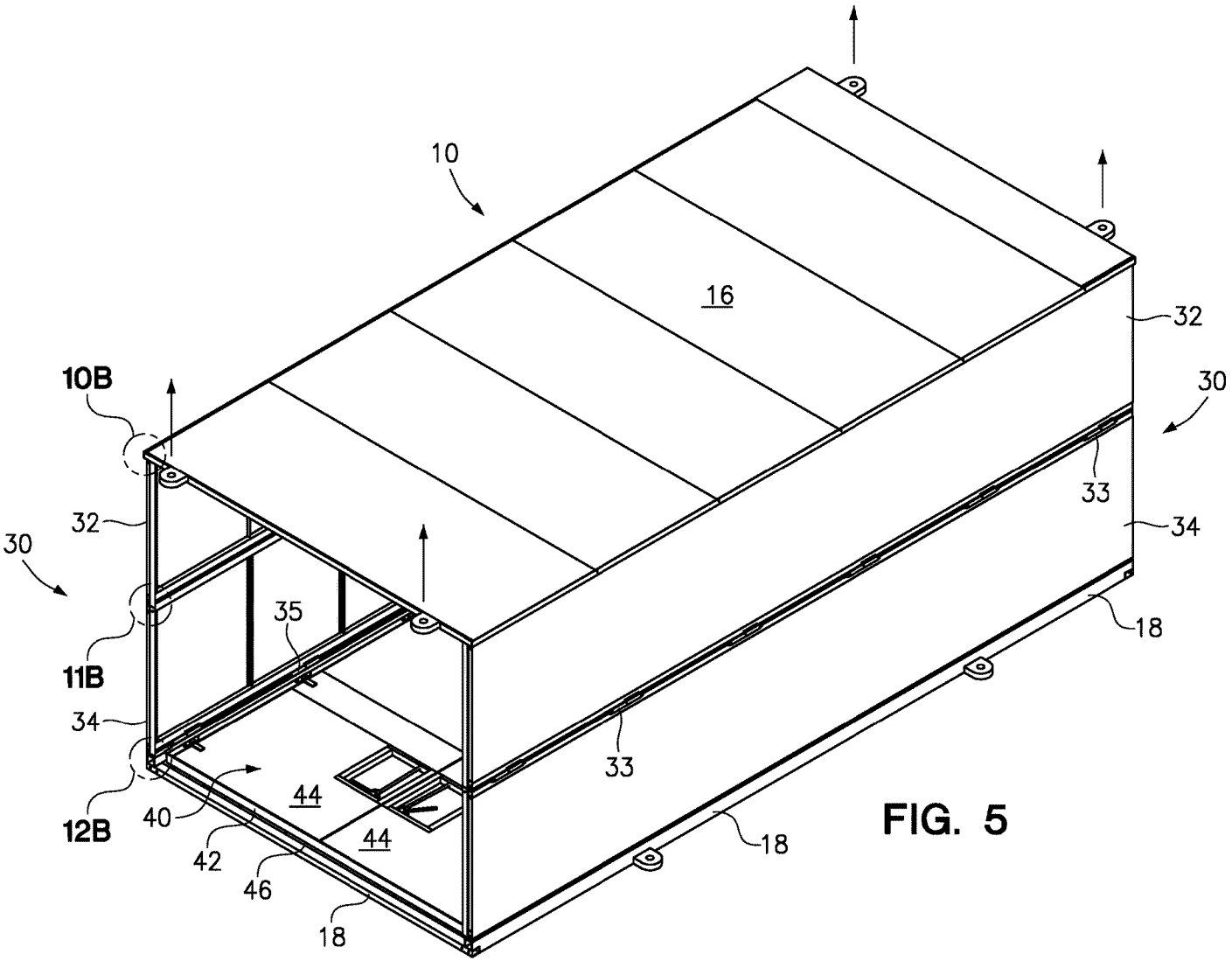
FIG. 5 is a perspective view of the folding storage unit with the walls in a fully erected condition and the end panel still folded.

FIG. 5 is a perspective view of the folding storage unit 10 with the walls 30 in a fully erected condition and the end panel 40 still folded down. Note that the upper wall section 32 and the lower wall section 34 for each of the opposing walls 30 are in an extended position with the wall sections aligned. The boom crane may hold the roof 16 at the elevation shown while the end panels 40 (only one shown) are moved into an operative position.

Figure 6:
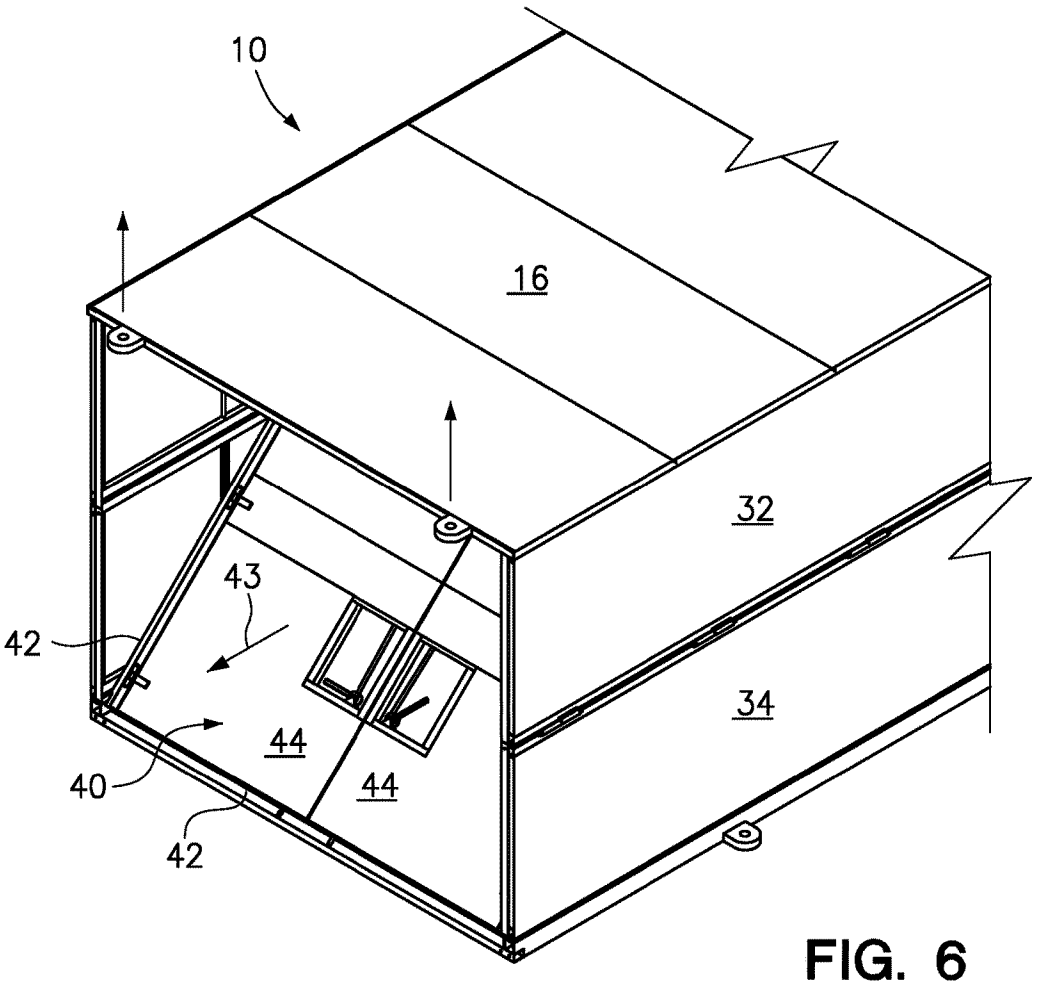
FIG. 6 is a perspective view of the folding storage unit during folding or unfolding of the end panel.

FIG. 6 is a perspective view of the folding storage unit 10 during unfolding (or folding) of the end panel 40. The end panel 40 may be pulled in the direction of the arrow 43 with a winch cable or rope. With the walls 30 in the extended position, the end panel 40 is free to pivot upward from the base 18 toward the opening in the end of the storage unit 10.

Figure 7:
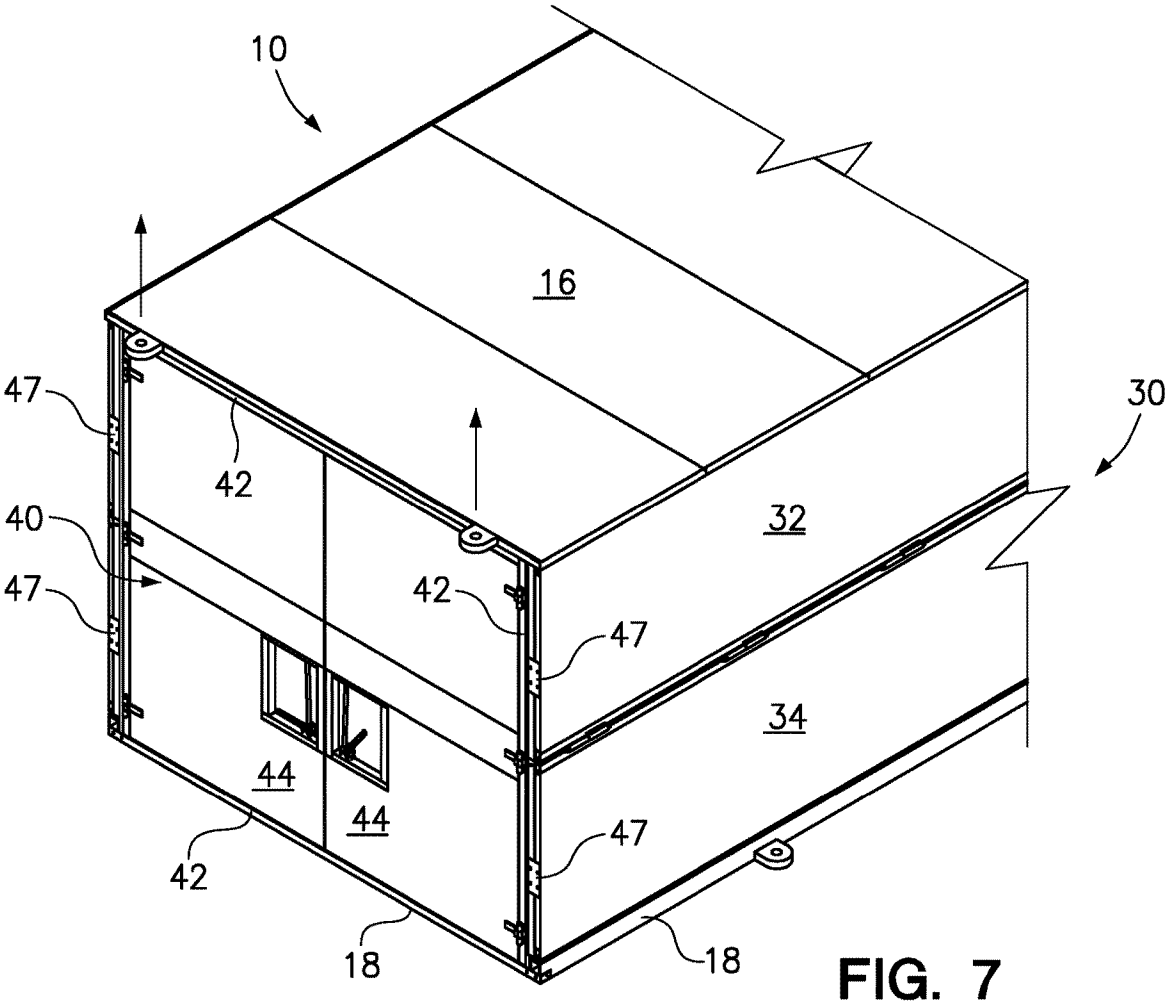
FIG. 7 is a perspective view of the folding storage unit with the end panel secured in a fully erected condition.

FIG. 7 is a perspective view of the folding storage unit 10 with the end panel 40 secured in a fully erected condition. As shown, the end panel 40 is substantially perpendicular to each of the walls 30, roof 16 and base 18. In this operative position, the rigid frame 42 of the end panel 40 prevents the wall sections 32, 34 from folding inwardly and holds up the roof 16. Since the roof 16, base 18 and wall sections 32, 34 are each rigid, this position of the end panel 40 prevents the storage unit 10 from collapsing. Therefore, the end panel 40 may be secured in the operative position shown by bolting or otherwise fastening the end panel 40 to the side walls 30 or the roof 16. In the embodiment shown, the end panel 40 is secured to the side walls 30 using a plurality of metal plates 47 with holes for a first set of bolts to be secured to the side walls 30 and a second set of bolts to be secured to the frame 42 of the end panel 40.

Figure 8:
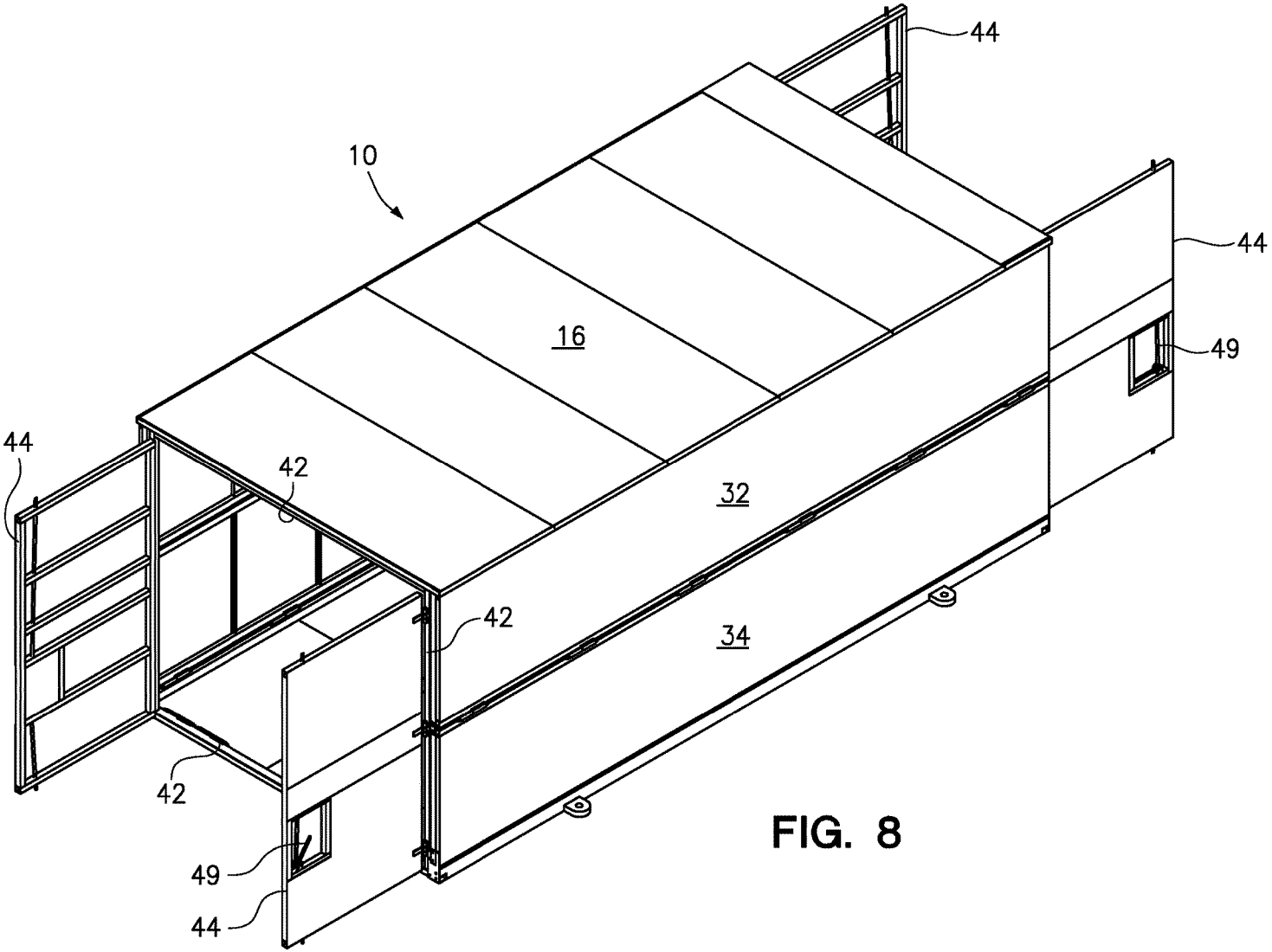
FIG. 8 is a perspective view of the folding storage unit in a fully erected condition with the doors open to allow access into the storage unit.

FIG. 8 is a perspective view of the folding storage unit 10 in a fully erected condition with each end panel having a pair of doors 44 open to allow access into the storage unit 10. As previously discussed, each end panel has a frame 42 that is secured in the operative position shown. However, the doors 44 are coupled to opposing vertical sides of the frame 42 with the hinges 48 that allow any one or more of the doors to be open for access into the storage unit 10. The doors 44 preferably also include a latching mechanism 49 that secured the doors 44 in a closed position within the frame 42 (see FIG. 7).

Figure 9:
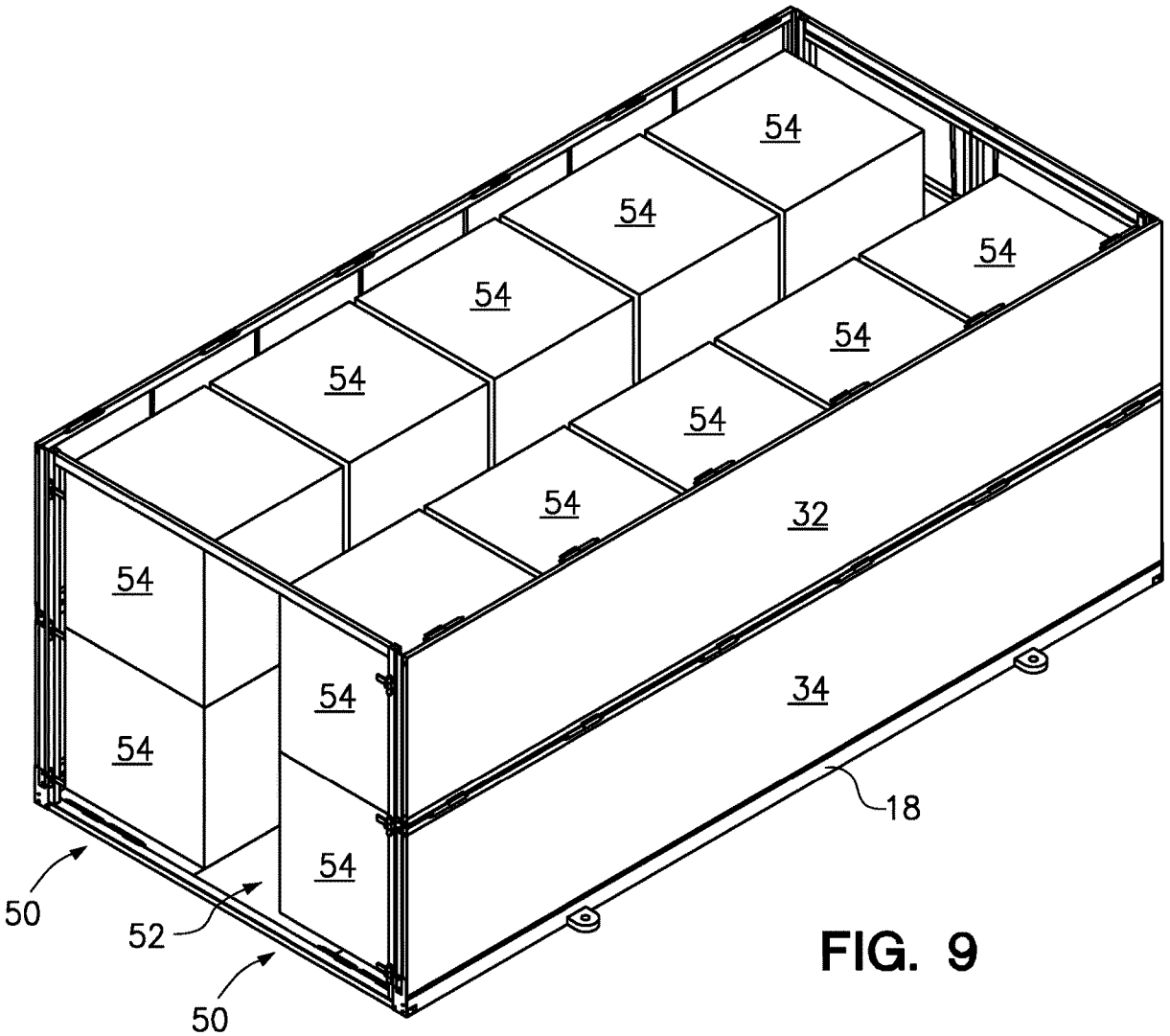
FIG. 9 is a schematic perspective view of the folding storage unit with the roof and one door panel removed to illustrate the storage of palletized goods within the storage unit.

FIG. 9 is a schematic perspective view of the folding storage unit 10 with the roof and the doors of one end panel removed in order to illustrate the storage of palletized goods within the storage unit. In the illustrated embodiment, the base 18 and roof may have a total width of about 10½ feet wide and a total length of about 21½ feet long in order to provide an interior storage space that is about 10 feet wide (from side to side) and about 21 feet long (from end to end). The height of the interior storage space may vary, but is preferably between 8 and 10 feet. Accordingly, it is possible to store a row 50 of standard pallets 54 (typical dimensions of 40 inches by 48 inches) of inventory on either side of a central aisle 52. It is possible to position the pallets so as to leave a central aisle 52 about 2 feet wide between the rows 50 of pallets, such that an individual can gain easy access to each pallet. Optionally, pallets of items may be stacked two or more pallets high, such that the storage unit may accommodate about 20 fully loaded pallets 54.

Figure 10A:
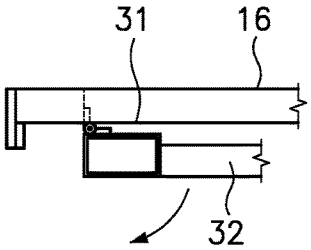
FIGS. 10A-10B are diagrams illustrating how adjoining roof and upper wall members move between a folded condition (see FIG. 3) and an unfolded condition (see FIG. 5).
Figure 10B:
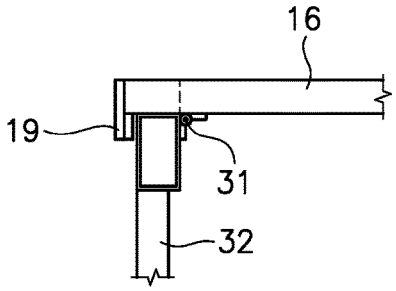

FIGS. 10A-10B are diagrams illustrating how adjoining roof 16 and upper wall sections 32 move between a folded condition (see FIG. 3) and an unfolded condition (see FIG. 5). FIG. 10A shows the roof 16 and an upper wall section 32 coupled by a hinge 31 and positioned in a folded condition with the upper wall section 32 generally parallel to the roof 16. FIG. 10B shows the roof 16 and an upper wall section 32 after the upper wall section 32 has pivoted about the hinge 31 to an extended position. Note that the upper edge of the upper wall section 32 is positioned under a lip 19 that prevents water from getting into the storage container 10.

Figure 11A:
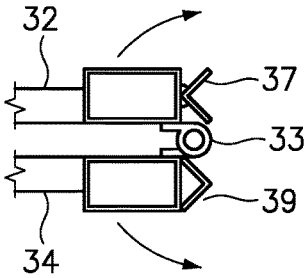
FIGS. 11A-11B are diagrams illustrating how adjoining upper wall and lower wall members move between folded condition (see FIG. 3) and an unfolded condition (see FIG. 5).
Figure 11B:
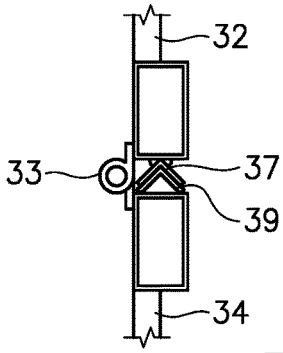

FIGS. 11A-11B are diagrams illustrating how adjoining upper wall section 32 and lower wall section 34 move between folded condition (see FIG. 3) and an unfolded condition (see FIG. 5). FIG. 11A shows the upper wall section 32 and the lower wall section 34 coupled by a hinge 33 and positioned in a folded condition with the upper wall section 32 generally parallel to the lower wall section 34. Note the position of a concave edge formed by a first angle iron 37 and a convex edge formed by a second angle iron 39. FIG. 11B shows the upper wall section 32 and the lower wall section 34 after pivoting about the hinge 33 to an extended position. Note that the convex edge 39 of the lower wall section 34 has moved into the concave edge 37 of the upper wall section 32. In this position, water is prevented from getting into the storage container 10 between the edges 37, 39 of the upper and lower wall sections.

Figure 12A:
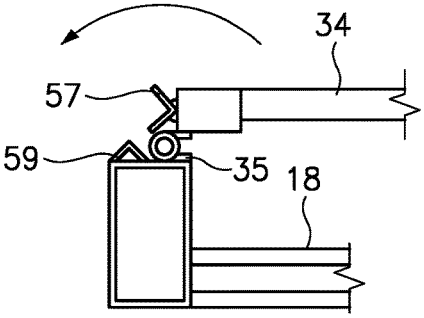
FIGS. 12A-12B are diagrams illustrating how adjoining base and lower wall members move between folded condition (see FIG. 3) and an unfolded condition (see FIG. 5).
Figure 12B:
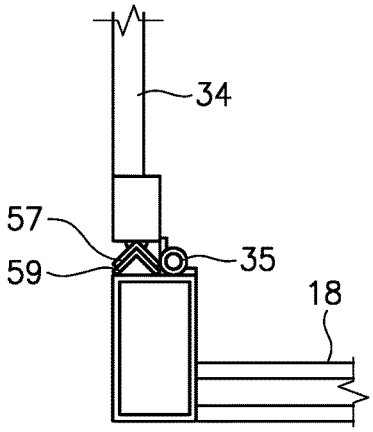

FIGS. 12A-12B are diagrams illustrating how adjoining base 18 and lower wall sections 34 move between folded condition (see FIG. 3) and an unfolded condition (see FIG. 5). FIG. 12A shows the base 18 and the lower wall section 34 coupled by a hinge 35 and positioned in a folded condition with the lower wall section 34 generally parallel to the base 18. Note the position of a concave edge formed by a first angle iron 57 and a convex edge formed by a second angle iron 59. FIG. 12B shows the lower wall section 34 after pivoting about the hinge 35 to an extended position. Note that the concave edge 57 of the lower wall section 34 has moved over the convex edge 59 of the base 18. In this position, water is prevented from getting into the storage container 10 between the edges 57, 59 of the lower wall section and base.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A collapsible storage unit, comprising:

a rigid base that is generally planar and has opposing first and second side edges and opposing first and second ends;

a rigid roof that is generally planar and has opposing first and second side edges and opposing first and second ends;

a first side wall including a first upper side wall section hinged to the first side edge of the roof and a first lower side wall section hinged to the first side edge of the base, wherein the first upper side wall section is hinged to the first lower side wall section, and wherein the first upper side wall section and the first lower side wall section can be articulated between an extended condition and a collapsed inward condition;

a second side wall including a second upper side wall section hinged to the second side edge of the roof and a second lower side wall section hinged to the second side edge of the base, wherein the second upper side wall section is hinged to the second lower side wall, and wherein the second upper side wall section and the second lower side wall section can be articulated between an extended condition and a collapsed inward condition;

a first end panel including a first frame and a first door secured to the first frame, wherein the first end panel is hinged to the first end of the base and can be articulated between an collapsed condition against the base and an extended condition securable to a first end of the first side wall and a first end of the second side wall;

a second end panel including a second frame, wherein the second end panel is hinged to the second end of the base and can be articulated between a collapsed condition against the base and an extended condition securable to a second end of the first side wall and a second end of the second side wall; and a flat surface formed by one of adjacent first side edges and adjacent second side edges of the base and roof with the folding storage unit in the collapsed condition; and at least one hook along the other of the adjacent first side edges and adjacent second side edges of the base and roof;

wherein the flat surface allows the folding storage unit to be set on a flat surface in an upright orientation; and wherein the at least one hook facilitates lifting the folding storage unit in the upright orientation with the flat surface directed downward.

2. The folding storage unit of claim 1, wherein the base and roof are rigid members having a width greater than 9 feet and length greater than 9 feet.

3. The folding storage unit of claim 2, wherein an interior of the folding storage unit has a width dimension that is greater than 9 feet.

4. The folding storage unit of claim 1, wherein the first and second sets of side wall sections fold inward allowing the base and roof to collapse to a height of less than 2 feet.

5. The folding storage unit of claim 1, wherein the folding storage unit can be set on a common side edge of the base and the roof for transportation.

6. The folding storage unit of claim 5, wherein the folding storage unit can be set side-by-side with four more of the folding storage units on a flatbed trailer that is no more than 8 feet, 6 inches wide.

7. The folding storage unit of claim 1, wherein the first door is hinged to the first frame.

8. The folding storage unit of claim 1, further comprising:

weather stripping secured to lateral edges of the first and second end panels for sealing against the first and second side walls.

9. The folding storage unit of claim 1, wherein the first end panel is secured to the first and second side walls in the extended position using a metal plate and bolts.

10. A collapsible storage unit, comprising:

a rigid base that is generally planar and has opposing first and second side edges and opposing first and second ends;

a rigid roof that is generally planar and has opposing first and second side edges and opposing first and second ends;

a first side wall including a first upper side wall section hinged to the first side edge of the roof and a first lower side wall section hinged to the first side edge of the base, wherein the first upper side wall section is hinged to the first lower side wall section, and wherein the first upper side wall section and the first lower side wall section can be articulated between an extended condition and a collapsed inward condition;

a second side wall including a second upper side wall section hinged to the second side edge of the roof and a second lower side wall section hinged to the second side edge of the base, wherein the second upper side wall section is hinged to the second lower side wall, and wherein the second upper side wall section and the second lower side wall section can be articulated between an extended condition and a collapsed inward condition;

a first end panel including a first frame and a first door secured to the first frame, wherein the first end panel is hinged to the first end of the base and can be articulated between an collapsed condition against the base and an extended condition securable to a first end of the first side wall and a first end of the second side wall;

a second end panel including a second frame, wherein the second end panel is hinged to the second end of the base and can be articulated between an collapsed condition against the base and an extended condition securable to a second end of the first side wall and a second end of the second side wall;

a lower edge on the first upper wall section that is concave;

an upper edge on the first lower wall section that is convex;

wherein the extended condition of the first upper and lower wall sections positions the convex edge of the first lower wall section into the concave edge of the first upper wall section; and a lower edge on the second upper wall section that is concave; and an upper edge on the second lower wall section that is convex;

wherein the extended condition of the second upper and lower wall sections positions the convex edge of the second lower wall section into the concave edge of the second upper wall section.

11. The folding storage unit of claim 10, wherein the concave edges of the first and second upper wall sections and the convex edges of the first and second lower wall sections are each made with an angle iron.

12. The folding storage unit of claim 10, wherein the first lower wall section has a lower edge that is concave and the first side edge of the base has an upwardly directed convex member, and wherein the extended condition of the first lower wall section positions the convex member of the base into the concave edge of the first lower wall section.

13. A collapsible storage unit, comprising:

a rigid base that is generally planar and has opposing first and second side edges and opposing first and second ends;

a rigid roof that is generally planar and has opposing first and second side edges and opposing first and second ends;

a first side wall including a first upper side wall section hinged to the first side edge of the roof and a first lower side wall section hinged to the first side edge of the base, wherein the first upper side wall section is hinged to the first lower side wall section, and wherein the first upper side wall section and the first lower side wall section can be articulated between an extended condition and a collapsed inward condition;

a second side wall including a second upper side wall section hinged to the second side edge of the roof and a second lower side wall section hinged to the second side edge of the base, wherein the second upper side wall section is hinged to the second lower side wall, and wherein the second upper side wall section and the second lower side wall section can be articulated between an extended condition and a collapsed inward condition;

a first end panel including a first frame and a first door secured to the first frame, wherein the first end panel is hinged to the first end of the base and can be articulated between an collapsed condition against the base and an extended condition securable to a first end of the first side wall and a first end of the second side wall; and a second end panel including a second frame, wherein the second end panel is hinged to the second end of the base and can be articulated between an collapsed condition against the base and an extended condition securable to a second end of the first side wall and a second end of the second side wall;

wherein the first and second upper wall sections, the first and section lower wall sections, the roof and the base each include a sheet metal barrier secured to a support structure made of angle iron.

* * * * *